United States Patent [19]

Lange

[11] Patent Number: 4,824,113

[45] Date of Patent: Apr. 25, 1989

[54] CHANCE GAME MACHINE

[76] Inventor: Georg Lange, Heidelberger Str. 21, S-2800 Bremen 1, Fed. Rep. of Germany

[21] Appl. No.: 29,043

[22] PCT Filed: Jun. 4, 1986

[86] PCT No.: PCT/DE86/00232

§ 371 Date: Mar. 23, 1987

§ 102(e) Date: Mar. 23, 1987

[87] PCT Pub. No.: WO86/07482

PCT Pub. Date: Dec. 18, 1986

[30] Foreign Application Priority Data

Jun. 5, 1985 [DE] Fed. Rep. of Germany ..... 3520123

[51] Int. Cl.[4] ..... A63F 5/02

[52] U.S. Cl. ..... 273/144 B

[58] Field of Search ..... 273/144 A

[56] References Cited

U.S. PATENT DOCUMENTS 1,376,874 5/1921 Hamel ..... 273/144 B
4,509,755 4/1985 Cheatham ..... 273/144 B

FOREIGN PATENT DOCUMENTS 3006 7/1932 Australia ..... 273/144 B
2044062 3/1962 Fed. Rep. of Germany .
2553153 7/1976 Fed. Rep. of Germany ... 273/144 B
646751 7/1928 France .

*Primary Examiner*—Paul E. Shapiro
*Attorney, Agent, or Firm*—Wegner & Bretschneider

[57] ABSTRACT

The invention relates to a chance game machine with winning opportunity, with at least one (drawing) chamber, which is equipped with a drawing device receiving playing elements after a mixing process, and from which one of a plurality of playing elements is to be drawn; a group of playing elements, which during a mixing phase are to be mixed by a mixing device and during mixing are freely movable in the chamber, is present in the chamber, and the group of playing elements contains at least two differently designed playing elements, of which one playing element during the drawing process is to be drawn by the drawing device and fed to a drawing receptacle; the drawing device has a number, corresponding to the number of playing elements of the group, of (playing-element) intermediate receptacles, which are arranged in the chamber for receiving one playing element each after the mixing process, and which, during a first drawing phase, are, with the exception of one intermediate receptacle, each blocked by a gate against deposition of a playing element in the drawing receptacle allocated to the group; the playing element located in the intermediate receptacle which is not blocked is to be fed to the drawing receptacle during a second drawing phase (FIG. 1).

30 Claims, 3 Drawing Sheets

CHANCE GAME MACHINE

Figure 1:
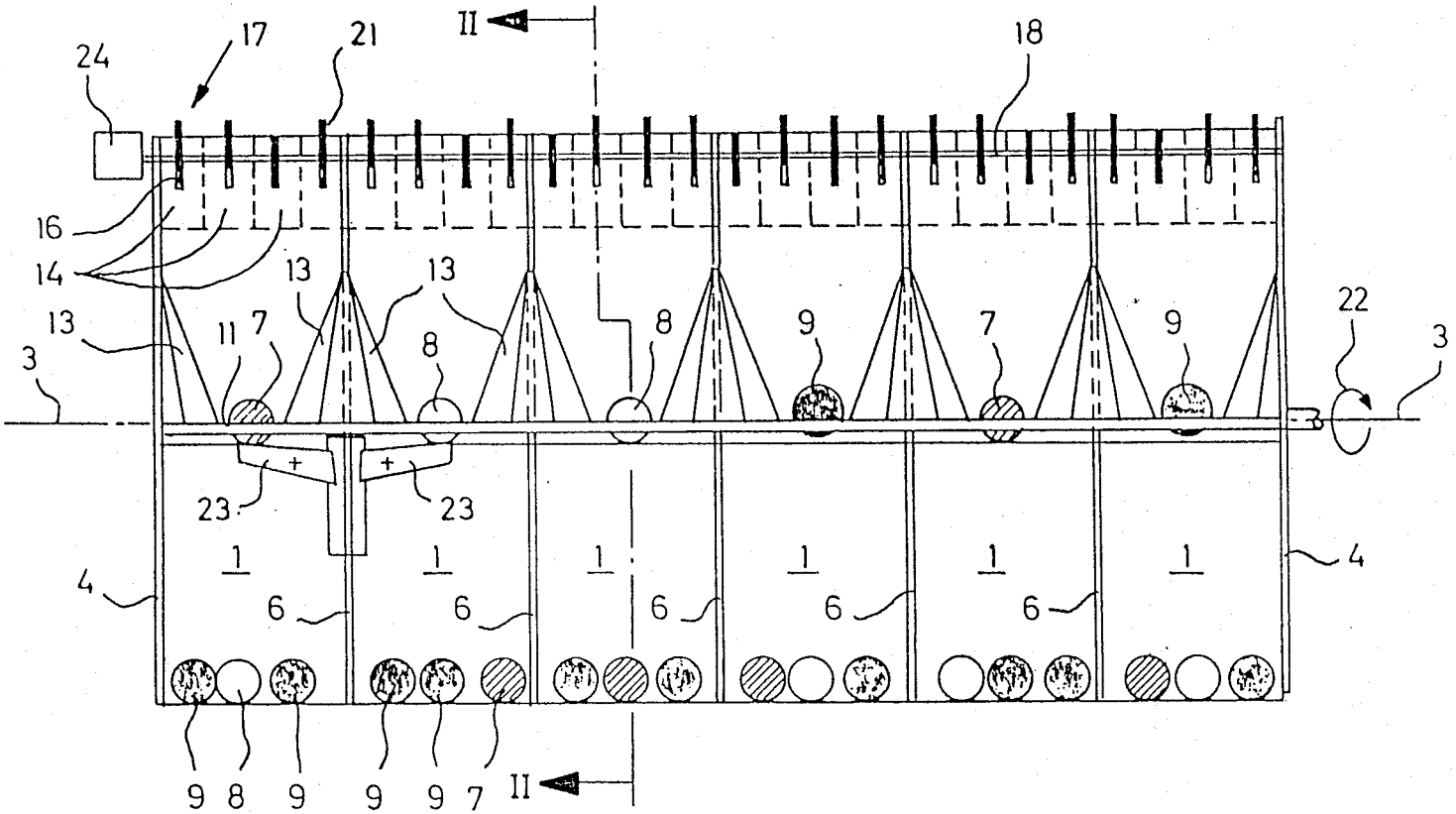

The invention relates to a chance game machine with winning opportunity, with at least one (drawing) chamber, which is equipped with a drawing device receiving playing elements after a mixing process, and from which one of a plurality of playing elements is to be drawn during one drawing.

Just as games of chance exist in great diversity, s also there exist the most diverse types of chance game machines which, depending on the winning opportunities and the organization of the course of play, are interesting in various ways for a player.

The criterion of all games of chance is that chance determines the outcome of the play. A problem for all chance game machines is therefore to ensure randomness of the win-determining events. The mastery of this problem must be effected according to increasingly stricter criteria the higher the payout ratio of a chance game machine is, since even a systematic deviation of as little as only a few percent from the statistical mean can lead to unprofitability and thus to uselessness of such a machine.

It is also common to all gambling establishments that many players enter them with a basic mistrust, which they feel in particular if they lose, in other words if an event favored by them, on which they have bet, does not occur. They then frequently suspect an illegal influence on the course of play to their disadvantage. In the case of a chance game (machine), this mistrust can be completely dispelled only if a player can become convinced that control of the drawing process (as generally acknowledged, this term is understood as the process in which the result of a game is determined), influencing the course of play, is not possible, in other words if, for example, a drawing occurs in a free play of forces in mechanical manner, as is the case, for example, in roulette.

In the present invention, therefore, special consideration is given to the two aforementioned viewpoints of "guarantee of randomness of the drawing results" and "trust of the player in the offered playing conditions".

The best known chance game machines are probably the socalled "one-armed bandits", in which a plurality of reels bearing symbols on their surfaces are each braked at a random point in time, whereupon the symbol combination of the symbols of several reels then appearing in a viewing window indicates the drawing result. At the present time, the random braking of the reels is controlled by electronic random-number generators, whereas complex electromechanical devices used to perform this function.

The typical feature of these chance game machines is that, with them, a very large number of playing results, drawing results is possible, of which, however, only a small number is winnable.

Usually these chance game machines have four reels, which are each provided on their surface with ca. twenty symbols, all of which are possible playing outcomes, so that in the case of four reels with twenty symbols each, 160,000 ($=1/20^4$) combinations of reel positions are possible. In total, however, only around ten to twenty different symbols, which occur in different frequency, are used. Corresponding to the different frequency with which the individual symbols occur, the possible symbol combinations also produce playing outcomes in different frequency. A small selection, usually around twenty, of these possible symbol combinations is winnable, but by far the great majority is not, so that on average a win is possible only on every seventh play or so.

The stake of the player always applies to all winning combinations, and he cannot place it at his option on certain winning combinations, i.e., he cannot play purposefully, i.e., methodically, according to a system.

The formulation of the win plan is based on a complex computation, which the player cannot simulate, which is why the payout ratio for him is not calculable. The attraction for the player is that the win in one play can amount to several thousand times the stake.

In addition to these chance game machines equipped with reels, there is the group of those which simulate the classical roulette game and which are known as roulette-like machines. These chance game machines differ from the reel-type machines mainly in the fact that, with them, only a very limited number of playing results is possible, all of which are capable of winning. In the case of these machines, the player therefore can and must bet on particular playing results, and the machine must be equipped with a table for placing bets.

The advantage for the player in the case of these chance game machines is that the payout ratio can easily be calculated and systematic play is possible. The disadvantage of these game machines is that the largest win, in the case of 36 compartment numbers, for example, cannot be greater than 35 times the stake, and so is very limited in contrast to the multiple of several thousand in the case of the reel-type machines.

The control of the playing outcome is effected by electronic random-number generators, and as a process is completely concealed from the player and not further understandable to him.

Distinguished from these two groups of chance game machines are chance game machines in which freely movable playing elements are used, and the drawing occurs more or less in a free play of forces, a process which the player can follow and understand. This type of play development, i.e., the establishment of the playing result or of the drawing, is basically of advantage for the player by the mere fact that the process of drawing can hold his interest. With regard to the present invention, therefore, this group of chance game machines with freely movable playing elements will be discussed in more detail.

West German Patent No. 1,574,184 teaches a chance game machine in which spherical playing elements which physically are of at least partly different design are used, which during a drawing process are each more or less freely movable in a drawing chamber and in the drawing process collide with baffles having various spatial orientations relative to the drawing-chamber wall, so that on their path of movement from top to bottom during the drawing process they are randomly deflected, whereupon a specified number of playing elements ends up in a drawing receptacle and thus determines the playing result.

A first disadvantage of this known chance game machine is that the differences between the playing elements can indeed be reliably detected for the most part by appropriate devices of the game machine itself, if suitably sensitive recognition means are provided, but not by the particular player.

A further disadvantage of this known chance game machine lies in the relatively poor readability of the playing result, a situation which arises because of a structurally required vertical arrangement of the drawn playing elements in the drawing receptacle.

Further disadvantages of this known chance game machine lie in the expensiveness of the plurality of playing elements of physically different design (and thus at the same time in a certain obscurity of the playing and especially drawing process for the player), in the expense to be incurred for realization of sensitive recognition means, and also in the organization and not least the course of the mixing process comprising one part of the drawing process.

To create suitable recognition devices for such chance game machines, it has been proposed in West German Patent No. 2,216,635 that the recognition area be provided with a light source and, as the actual recognition means, phototransistors, which are arranged adjustably over the length of the recognition area, concerning which the light source preferably extends over the entire length of the recognition area.

In contrast, the subject matter of West German Auslegeschrift No. 2,803,894 concentrates on an improvement of the mixing process comprising one part of the drawing process in such chance game machines, and for this purpose proposes that the playing elements be swirled by air in the drawing chamber during the mixing process. As regards this, however, it is to be noted that air basically does not differ from other mechanical mixing means such as suitably designed and arranged baffles or the like, so that, by means of mixing the playing elements by a gaseous medium such as air, it is basically qualitatively impossible ultimately to achieve a playing result which is better in terms of the aimed-for randomness.

A great advantage of such chance game machines, however, is the fact that the win-determining events basically occur practically in a free play of forces, and also insofar as they can be observed in their course and even understood by the player; that the win-determining events therefore do not occur in a manner unknown to the player, as is the case with the electronically controlled machines or the even now electromechanically controlled reel-type machines, in which, because of the design of these machines, the mode of operation of the devices ensuring the neutral randomness of the win-determining events remains concealed from the player.

West German Offenlegungsschrift No. 2,503,278 teaches a chance game machine with playing elements which are essentially movable during the playing process, and which are also balls, which in the case of this chance game machine known from the prior art are of identical rather than somehow different design. Accordingly, because of the use of identical playing elements, there is no need for special recognition means with which, after a drawing, the kind of playing elements which have been drawn is (automatically) determined.

In other words, in the chance game machine which West German Offenlegungsschrift No. 2,503,278 teaches, six playing balls, for example, fall successively within a vertical playing field of certain width, provided with baffles consisting of deflector pins, and provided along its side boundaries with strips, which taper downward and lead into two receiving shafts, of which one appropriately marked receiving shaft is at any time a so-called scoring shaft. A counting device consisting of two incrementally operating scoring counters operates in such a way that one scoring counter counts the scores of the first three playing balls which have been played and the other scoring counter counts the scores with the last three playing balls. Compared with other chance game machines described or at least mentioned above, therefore, this chance game machine known from the prior art already has for one thing the advantage among others that a drawing and thus the outcome of a play occurs in exciting yes-no steps which can be observed by the player.

The creator of the chance game machine according to West German Offenlegungsschrift No. 2,503,278 has further developed and varied the subject matter of this publication, especially for installation in casinos, in such a way that no longer do six playing balls fall successively through one and the same playing field (=drawing chamber) and thereafter through one of two receiving shafts (=drawing receptacles), but six playing fields (each also equipped with deflecting baffles), in each of which a spherical playing element is present or introduced into the particular playing field, are present in this further-developed chance game machine, wherein the spherical playing elements each fall during the drawing process—as in the chance game machine according to West German Offenlegungsschrift No. 2,503,278—into one of two receiving shafts allocated to each playing field (=chamber), once again only one (appropriately marked) receiving shaft alternately being a scoring shaft at any time, so that this affords not only a better presentation of the playing and drawing result and a corresponding check after the event, but also a (much) faster course of play, so that, with such a chance game machine, many more plays per unit time can proceed than with the chance game machine according to West German Offenlegungsschrift No. 2,503,278, which obviously is much more advantageous for the casino.

Although in this further developed chance game machine already known from the subject matter of West German Offenlegungsschrift No. 2,503,278 it can also be mentioned as an advantage that wins between twofold and sixtyfold are realizable with a high payout ratio of ca. 94% for all chances that the win-determining events are observable, visible and accordingly understandable as well as interesting for a player, since they consist of yes-no steps occurring in a free play of forces, and that furthermore also the winning plan is obvious and the payout ratio calculable, concerning which it would have to be added as a further advantage that each play outcome is winnable and therefore leads to a win provided it has been bet on by the player, concerning which it would have to be mentioned as one disadvantage among others that the playing result is not clearly apparent at first glance, as is desirable at least from the viewpoint of the player. As further disadvantages, for example, the relatively complex playing-element guidance and the high construction expense are to be mentioned.

However, the main disadvantage of this game machine known from the prior art is that the spherical playing elements can be subjected during the drawing to certain compulsory guiding influences, which lead to preferred drawing results, which do not correspond to one-hundred-percent randomness.

Accordingly, the object of the present invention is, while avoiding or at least reducing the above-mentioned and further disadvantages, to create a chance game machine of the type described in the introduction, i.e., a chance game machine with freely movable playing elements, in which the course of the game is interesting and exciting for the player and at the same time is obvious and therefore can be checked, in which not only is every individual play to be winnable, which permits the player to play purposefully, but also large individual wins on the order of several thousand times the stake are to be possible, and in which, moreover, despite the fact that the drawing process is preferably of exclusively mechanical configuration, systematic errors, i.e., any kind of influences limiting the randomness of the playing results, are to be prevented with certainty, so that, to the advantage of the player, the calculation of the winning plan can be based on a high payout ratio, and, in addition to these advantages, a relatively rapid course of play of an individual play is to be possible, in the interest of the player and particularly in the interest of the casino, since with a high payout ratio the interest of the casino is protected only by means of a high turnover.

To achieve this object, it is provided according to the invention that a group of playing elements, which during a mixing phase are to be mixed by means of a mixing device and during mixing are practically freely movable in the chamber, is present in the chamber (of which preferably several are present, as is further explained in detail later), and that the group of playing elements contains at least two differently designed playing elements, of which one playing element during the drawing process is to be drawn by means of the drawing device and fed to a drawing receptacle, the drawing device having a number, corresponding to the number of playing elements of the group, of (playing-element) intermediate receptacles, which are arranged in the chamber for receiving one playing element each after the mixing process, and which, during a first drawing phase, i.e., an intermediate phase after mixing and before the actual final drawing process, are, with the exception of one intermediate receptacle, each blocked by means of a gate against deposition of a playing element in the drawing receptacle allocated to the group, the playing element located in the intermediate receptacle which is not blocked being fed to the drawing receptacle during a second drawing phase.

As already indicated above, it is preferable that not merely one such mixing and drawing chamber be present in the chance game machine according to the invention, but that the chance game machine in the most preferred configuration have six such chambers, which each contain a preferably identical group of playing elements, a configuration with four playing elements in three varieties, so that two playing elements are identical to each other, having proven particularly suitable.

The drawing process in this configuration of the game machine now comprises the fact that one playing element is drawn in each of the six chambers. The six playing elements then drawn therefore represent the playing result, which is evaluated according to the number in which the individual varieties (preferably three in this case) have each been drawn.

The individual varieties are made recognizable to the player (as will be described in more detail later) by different coloration, and here are to be yellow, blue and black; the two playing elements identical to each other are to be black. Drawing results can then be, for example: 3×black, 2×blue, 1×yellow, or: 6×black, or: 5×yellow, 1×blue, etc.

The mathematical relationships are now quite clearly the following: The probability of drawing a black playing element is $\frac{1}{2}$; the probability of drawing a yellow playing element is $\frac{1}{4}$; the probability of drawing a blue playing element is $\frac{1}{4}$. The probability of now drawing six yellow playing elements in a game is $\frac{1}{4}^6=1/4096$; the probability of drawing six black playing elements is $\frac{1}{2}^6=1/64$; the probability of drawing three black (and three other) playing elements is 20/64. The wins guaranteeable in these playing results, given by way of example, could be, in the above order: 3800 times, 60 times and 3 times the particular stake.

It is therefore clear here that a wide range of wins can be offered with the procedure of the invention and that, in particular, *the* requirement of the object of the invention, of making possible individual wins on the order of several thousand times the stake, can be met.

The mathematical value of $1/4096=(\frac{1}{4}^6)$ which controls the setting of the largest individual win in the preferred configuration of the game machine with six chambers depends on the two factors 4 (=number of playing elements per chamber) and 6 (=number of chambers). Naturally these two factors can basically be changed as desired, so that the intent of the invention could also be realized with a different configuration of the game machine with more or fewer chambers and/or more or fewer playing elements per chamber.

The configuration of the game machine with six chambers, as is preferred in terms of the requirements of the object of the invention has the following advantages: individual wins, which are attractive to the player, on the order of several thousand times the stake are possible.

The conditions of the individual drawings are very simple and quite obvious to the player. Per individual drawing (per chamber), only three drawing results are possible (namely black or yellow or blue), and the probabilities (namely $\frac{1}{2}$ and $\frac{1}{4}$) with which they are to be expected are immediately understandable to the player. Accordingly the player also easily understands how the (overall) playing result comes about, and the payout ratio can be calculated by him. By the fact that two of the four separate playing elements are identical to each other, it is possible very simply to condense all possible playing results, since all are winnable and accordingly can be bet on, into a few bettable chances and to formulate a simply constructed winning plan, which is fully understandable by the player and which, for example, could have the following appearance:

| | | | |
|---|---|---|---|
| 6 × yellow | 3800 | 6 × black | 60 |
| 6 × blue | 3800 | 0 × black | 60 |
| 5 × yellow | 200 | 5 × black | 10 |
| 5 × blue | 200 | 1 × black | 10 |
| 4 × yellow | 28 | 4 × black | 4 |
| 4 × blue | 28 | 2 × black | 4 |
| | | 3 × black | 3 |

The payout ratio would be approximately the same for all chances and on average would be around 93%. According to the invention the playing elements are preferably spherical, because firstly balls are simple elements (and also easy to manufacture) and secondly they can be easily mixed, because their surface has identical properties practically at every position. Nevertheless, it is basically obvious that other playing elements are also conceivable and usable for the chance game machine according to the invention, especially rotationally symmetric elements of different kind or the like.

By means of different colors, playing balls can be made distinguishable simply and, for the player, clearly, and also electronic color-recognition elements exist with which the recognition means of a game machine could be equipped. Such electronic color-recognition elements are extremely unsuitable for use in the game machine of the invention, however, because they are adjustable only to particular color values under particular lighting and reflection conditions.

The color values of the ball surfaces are altered merely by the unavoidable roughening of the playing-ball surfaces in the course of the operating time of the machine, and by the fact that they become dirtied by dust and wear. Protection against alteration of the lighting conditions and/or against manipulative influences by means of light, e.g., colored light, would be achievable only with the greatest expense and probably not at all satisfactorily.

It must be emphasized here once again that freely movable playing elements which are physically different cannot be mixed ideally. In the case of the playing elements provided by the invention, e.g., four per (mixing, drawing) chamber, these four playing elements, in a final position after mixing, do not assume every combinatorially possible spatial arrangement with respect to each other with equal frequency. Even during mixing their spatial position in the chamber is not purely random, but is codetermined by their physical condition, so that drawing results which could be qualified as 100% random are not directly possible, neither in drawing from a final position nor in drawing "on the fly". In drawing "on the fly", such results are even less to be expected, because in this case the physical variability of the playing elements has an even greater influence, e.g., by the mutual displacement of the playing elements (as a result of their physical variability, by weight, size, shape or surface condition) at the instant of drawing, whereby, in addition, a reliable drawing (i.e., in which one playing element is actually always trapped, reliably received by a receiving means) becomes problematic.

In the drawing from a stationary or final position after mixing, as is to be preferred for these reasons, the four playing elements which are preferably provided are now, in the game machine according to the invention, in such a stationary or final position after mixing, not found in every combinatorially possible sequence with the same frequency in the already mentioned intermediate receptacles, which represent an important feature of the invention, but instead preferred orientations occur in the (four) positions of the row, so that, if drawing is continually performed from an arbitrary, given position of this row, the drawing results are not absolutely random, but also depend on the chosen drawing position.

The mixing described here is not really superfluous, and the arrangement of the four playing elements in the intermediate receptacles after mixing is also random insofar as it is not predictable in the individual case. In the present invention, however, the intention is to ensure that the evaluation of the possible drawing results according to the playing plan can be done solely on the basis of the quantitative composition of the varieties of a playing-element group—an evaluation which also corresponds to the natural expectation of the player—which presupposes, however, that all playing elements ultimately can be drawn with equal frequency, because only then is it possible to predict that, for example, a variety A of playing elements which is present twice in a total group of playing elements of different varieties will be drawn twice as frequently as a variety B of playing elements which is present only once in the total group.

If the drawing results are exclusively dependent on chance, the prerequisite is met that all playing elements of a group be drawn with equal frequency. Conversely, it can be said that: If all playing elements of a group of freely movable playing elements are drawn with equal frequency, then the drawing results are exclusively dependent on chance. According to the invention, the described fact that the playing elements do not appear with equal frequency in the individual intermediate receptacles is therefore taken into account in that the playing elements are to be drawn from all intermediate receptacles, as is explained in detail later.

Although other configurations also seem possible, according to the invention a configuration with chambers arranged side-by-side is regarded as particularly preferred, since side-by-side chambers have a common axis of rotation and naturally also a single drive, a common control system, etc., and can be designed integrally, the only necessity being, for example in a configuration of the mixing device as a kind of drum, as is preferably intended, that the individual chambers be separated from each other by radial partitions. In such or a similar configuration (the outer wall obviously does not necessarily have to be cylindrical, but can, for example, be designed as a polygon, etc.), then ultimately a single mixing device, i.e., only one drive (motor and if necessary gears), one control system, etc., is present for several or preferably all chambers.

According to the invention, the different configuration of the playing elements of a group is preferably realized by a different size of the playing elements (with the same material), and thus, in the case of balls, by balls of different diameter ; it is sufficient for reliable recognition of the particular playing elements if the difference in diameters of the preferably spherically designed playing elements is relatively small (i.e., for example, equal to 20, 21 and 24 mm).

On the other hand, however, it is obvious that balls of relatively slightly different configuration with regard to their diameter are recognizable only with relative difficulty by the player, so that a further feature of the invention is to realize the different configuration of the playing elements of a group at least on the outside thereof by a different coloration; however, this different coloration, in accordance with the above facts relating to this matter, is used not for instrumental recognition of the drawn playing elements, but only for the purpose of giving the players the opportunity immediately to be able to recognize a drawn playing result. Thus, for example, the smallest playing-element ball of a group can be made blue, the medium ball size yellow and the largest playing-element size black, so that the colors simultaneously are a synonym for the particular size and vice versa, and thus, together with the different size, permit simple recognition of a drawn playing result—for the machine by means of the ball size and for the player by means of the ball coloring—.

The playing-element intermediate receptacles representing an important feature of the present invention can be designed as tracks, which are adapted in cross section to the playing-element configuration and which are each to be put in communication with a drawing receptacle of the applicable chamber; a releasable gate already mentioned above is arranged in each case between an intermediate receptacle and the drawing receptacle, as is also described in detail later.

In order to be able, after release of the gates, to do without any kind of complex drawing devices, by means of which the applicable playing result is then ultimately determined definitively by drawing, the tracks serving as intermediate receptacle can be inclined toward the drawing receptacle, so that, in the case of a configuration of the playing elements as balls, a ball which is not blocked then runs spontaneously because of gravity into the drawing receptacle, suching a configuration having not only the advantage of the possibility of simple realization for the manufacturer, but also the additional advantage of excellent visibility and obviousness for the player. Obviously, in such a design, there is also then provided a playing-element return device, which in each case is allocated to a drawing receptacle, in order that a drawn playing element is to be returned to the chamber after each play; such a playing-element return device, likewise with suitable design of the drawing receptacle and the arrangement thereof relative to the chamber, is to be realized in the simplest way in such a manner as to ensure that, during a mixing process of the next play, the drawn playing elements return spontaneously because of gravity to the chamber, and therein are mixed with the other playing elements of the applicable group.

In a further configuration of the present invention, it is possible to allocate to each drawing receptacle an evaluation device, preferably automatic, by means of which the variety of the drawn playing element is automatically to be determined (and if necessary recorded).

A most suitable configuration of an evaluation device according to the invention has a drawing receptacle, the internal passage cross section of which is reduced in steps, the topmost end segment of which is larger in cross section than the applicable size of all playing elements of the group, the segment of which immediately following the topmost end segment is no longer passable for a first variety of playing elements and receives this variety of playing elements, and the further reduced second segment of which following this first segment with reduced passage cross section is no longer passable for a second variety of playing elements, so that consequently a second variety of playing elements is received in this segment, etc.; a pick-up, with which it is automatically to be determined whether a playing element is present or not in the applicable segment of the evaluation device or of the drawing receptacle, can then be allocated to each segment for instrumental evaluation of the playing results.

In the case of the three varieties of playing elements preferably provided according to the invention, only 21 different data in total are possible, of which three are established in each play, although wins from two times (namely in the cases in which the chances offered are 2 or 4×black) to 3,800 times the stake are realizable therewith. In contrast, in the case, for example, of the roulette-like chance game machines, with 36 or 37 compartment numbers, 36 or 37 data relative to playing outcomes available, only wins up to 35 times the stake are realizable. In the case of the reel-type machines known as "one-armed bandits", on the other hand, wins on the order of several thousand times the stake are indeed realizable, but a very large number of data must be processed to determine the win in the case of these machines.

This above-mentioned, very simple drawing process to which the invention relates naturally could also be simulated electronically by allowing, for example, three separate symbols, of which, for example, two are again identical to each other, to be selected in each case from, for example, six pictorially represented symbols groups by electronic random-number generators or the like.

However, such an electronic design of the game machine according to the invention would have, in addition to other disadvantages (e.g., less excitement for the player, because no process which is observable and understandable in the course thereof occurs), in particular the disadvantage that the actual independence of the drawing of any possibility of being influenced would not be perceptible to the player, so that such a design has to be regarded as a clearly poorer embodiment as compared with the completely mechanical design which is most preferably intended.

The releasable gates for the playing-element intermediate receptacles, by means of which the intermediate receptacles, with the exception of one intermediate receptacle, are blocked in the final drawing process against deposition of a playing element in the drawing receptacle allocated to the group, consist preferably of cams, fingers or the like, which at first block the outlet side or discharge position of the applicable intermediate receptacles (so that the playing element located in the intermediate receptacle which is not blocked can be fed solely and, in this respect, also reliably to the drawing receptacle), and over which the playing elements which were at first retained fall back into the drawing and mixing chamber before the end of the drawing process. These cams, fingers or the like are, in a preferred configuration, mounted on a camshaft.

The number of cams, fingers or the like and the arrangement thereof on the camshaft are now organized such that, by stepwise turning of the camshaft, the intermediate receptacles are, one after the other, not blocked, so that, for example, if stepwise turning of the camshaft from play to play occurs, all intermediate receptacles will be not blocked (or blocked) with identical frequency in the course of a series of plays, so that drawing from all intermediate receptacles will occur with identical frequency in the course of a series of plays. According to the invention, it is provided that the turning of the camshaft by 0, 90, 180 or 260 degrees occurs randomly.

By means of an example it is explained in the following how the procedure of the invention in principle acts on the statistical frequency of the drawings of the individual playing balls:

After a thorough screening, let, for example, the average distribution of four separate playing balls, of which two are identical (A, B, C, C), over four positions (1, 2, 3, 4) from which they are to be drawn, be the following, converted to 100 drawings:

| | 1 | 2 | 3 | 4 | |
|---|---|---|---|---|---|
| A | 33 | 16 | 24 | 27 | = 100 |
| B | 29 | 22 | 18 | 31 | = 100 |
| CC | 38 | 62 | 58 | 42 | = 200. |

If now drawing results are necessary which correspond to the probability values of ¼ each for the playing balls A and B and of ½ for the identically designed playing balls CC, these are not to be attained in drawings from an arbitrary, given position.

Only if drawing from all positions with identical frequency is performed in an irregular sequence are the results pure chance results, as are to be expected for given probability values of ¼ and ¼ and ½. In our example, the average numbers, converted to 400 drawings of this type, would be the following:

| In each 100 drawings, from positions | 1 | | 2 | | 3 | | 4, | |
|---|---|---|---|---|---|---|---|---|
| playing balls A are drawn | 33 | + | 16 | + | 24 | + | 27 | = 100 times |
| playing balls B are drawn | 29 | + | 22 | + | 18 | + | 31 | = 100 times |
| and playing balls CC are drawn | 38 | + | 62 | + | 58 | + | 42 | = 200 times. |

In a preferred configuration of these gates, all cams or the like can be mounted on a camshaft or the like, which can be driven by a single drive, concerning which this drive preferably has a random-number generator, which effects random release of a playing element of a group held in the intermediate receptacle or the intermediate receptacles.

Preferred configurations of the present invention are described in the subclaims.

In the following, the invention is further explained, with reference to a drawing, by an exemplary embodiment.

Figure 2:
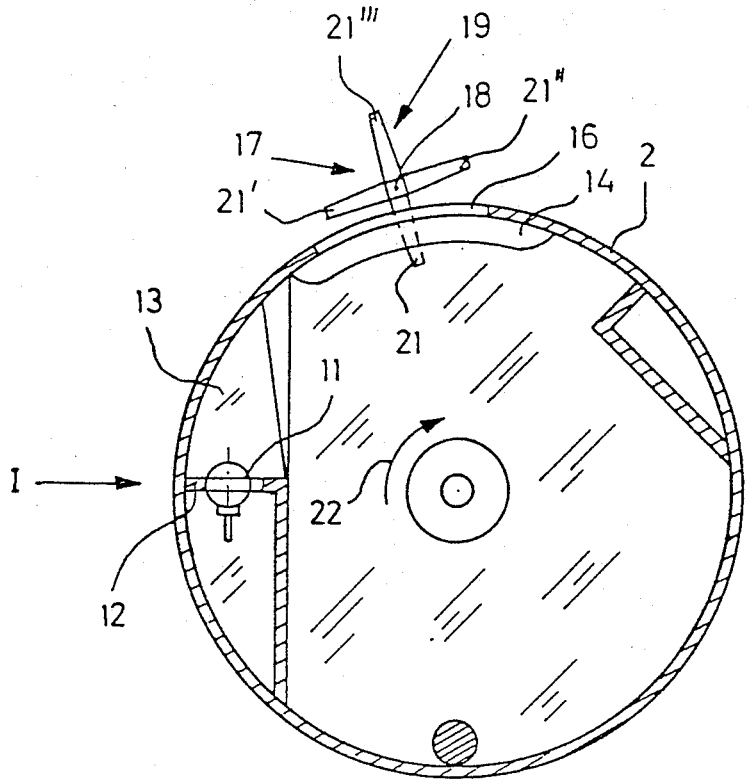
Figure 3:
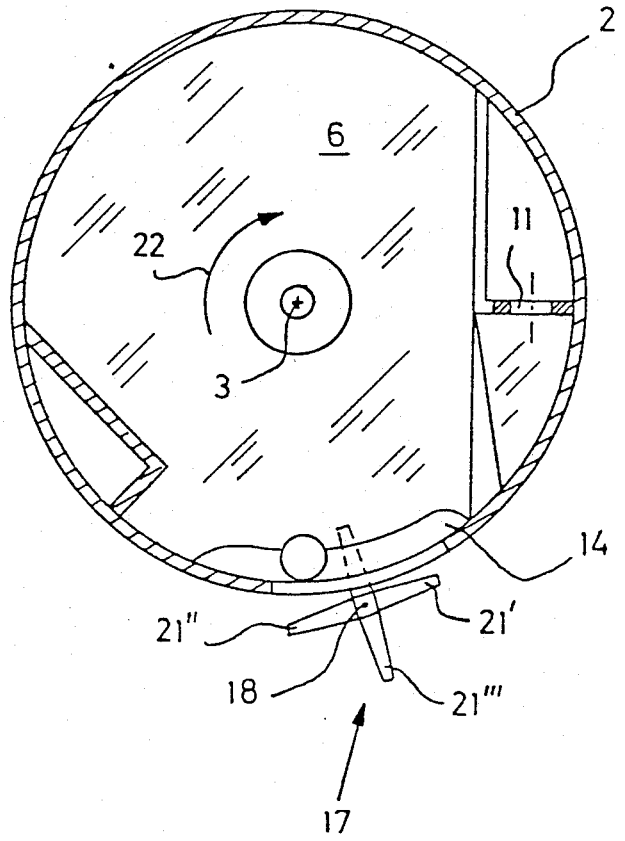

FIG. 1 shows a side view of the essential part of an exemplary embodiment of the chance game machine according to the invention, namely the mixing device which is designed as a drum, and which contains several (namely six) chambers, each with four spherically designed, playing elements of somewhat different configuration, as well as one drawing device per chamber, the diagram being partly schematized for better clarity and parts which are not essential according to the invention are left out;

FIG. 2 shows a section through the diagram according to FIG. 1 in the direction of section line II—II, just as in FIG. 1 after the end of a play or in the starting position for a new play; and FIG. 3 shows a diagram corresponding to FIG. 2 after the first drawing phase, the playing elements each being located in an intermediate receptacle.

The drawing shows, in a somewhat schematized diagram from which nonessential parts as, for example, of the drive, are left out, a preferred configuration of a chance game machine according to the invention with six essentially cylindrical (drawing) chambers 1. The chambers 1 are located in a cylindrical drum 2, of transparent plastic, which by means of a drive, not shown, is reversibly rotatable around the horizontally arranged longitudinal axis 3 thereof. The chambers 1 are each bounded by a an end wall 4 of the drum 2 and a radial partition 6, or by two partitions 6, 6. Located in each chamber 1 is a group of four spherical playing elements of the same material, which are of somewhat different configuration, and specifically, in each chamber 1, a blue ball, of shaded appearance in the drawing, with a diameter of 20 mm, a yellow ball, of white appearance in the drawing, with a diameter of 21 mm, as well as two black balls, of black appearance in the drawing, with a diameter of 24 mm. Since, because of the drawing scale, the slight size differences are not clearly representable in the drawing, the balls 7 to 9 used as playing elements appear in the drawing to be of essentially equal size, and only in the middle part of FIG. 1 are they shown in somewhat exaggerated size with respect to their diameter, in order that the mode of operation can be better illustrated.

FIG. 1 shows the chance game machine and therewith the drum 2 after the end of a play, and thus in the starting position for a new play, it being obvious that three balls are located at the bottom of each chamber 1, whereas the fourth ball of each group is held in a drawing receptacle 11.

As is obvious in particular from FIG. 2, the drawing receptacle 11 of each chamber consists of a through-hole, which is provided in a radial flange 12, and the diameter of which is somewhat smaller than the diameter of the smallest ball, which in the present case is the (blue) ball 7 with a diameter of 20 mm. If the diameter of the through-hole forming the drawing receptacle 11 is therefore ca. 19 mm, a ball 7 is indeed held, if it so happens, by the drawing receptacle 11, but nevertheless still penetrates with the lower segment thereof through the flange 12 and thus projects beyond the underside of the flange 12.

If, in contrast, a (yellow) ball 8, which has a diameter of 21 mm, is received by the drawing receptacle 11, basically the same thing happens with the difference that a ball 8, because of the somewhat larger diameter thereof, merely projects somewhat less beyond the underside of the flange 12. The same is true for reception of a (black) ball 9, which has a diameter of 24 m; even a ball 9 is reliably received by the drawing receptacle, although in the case of this third variety of balls it is not absolutely necessary that it project down beyond the flange 12, since even this leads, with a mechanical pick-up, to a corresponding indicator signal for reception of a particular ball in the drawing receptacle 11.

Located in the region of the flange 12 are inclined walls 13, which are directed toward the drawing receptacle 11, and the bottom ends of which each end in the flange 12 close to the hole forming the drawing receptacle 11, so that a drawn ball is always reliably guided to the applicable drawing receptacle 11 and received therewith.

Furthermore, each chamber 1 has a number, corresponding to the number of balls—and thus four in the present case—of intermediate receptacles 14 for receiving one ball each after a mixing process. The intermediate receptacles 14 are installed on the circumference at a distance from the drawing receptacles 11 (see FIG. 2 in particular). They each take up the length of a chamber 1, measured in the longitudinal direction of the drum 2, and are of groove-like design, so that, after the mixing process, each intermediate receptacle 14 is occupied by 1 ball.

Each intermediate receptacle 14 is provided with a slot 16, which extends through the casing of the drum 2, and which is a functional component of a gate indicated as a whole with 17. The gate 17 has, located on the outside of the drum 2 and extending over the entire length thereof, a shaft 18, with a square cross section, on which a catch 19, mounted rigidly on the shaft 18, is located in each case at the position of a slot 16. Each catch 19 has three retaining fingers 21 arranged at right angles to each other, so that the catches 19 viewed end-on have T-shaped design, and consequently a retaining finger 21″ is in each case located opposite a retaining finger 21′, whereas no retaining finger is located opposite the interposed retaining finger 21‴. In addition, the arrangement of the retaining fingers 19 is organized such that neighboring retaining fingers 19 of a chamber 1 are in each case turned by 90° relative to each other, so that therefore three intermediate receptacles 14 are blocked at any time by a retaining finger 21, while the fourth intermediate receptacle 14 is not blocked. In the representation according to FIG. 2, all three retaining fingers 21', 21'' and 21''' obviously lie outside the drum 2, i.e., none of the retaining fingers 21 projects through the slot 16 into the drum, in order to block the applicable intermediate receptacle 14, while the other three intermediate receptacles 14 are each blocked by a retaining finger 21, as is indicated in FIG. 3 with a dot-dash line.

The mode of operation of the chance game machine according to the invention is as follows:

At the start of a play, a bet is placed by a player on a certain playing result, and then the mixing phase is initiated from the starting position shown in FIGS. 1 and 2; the drum 2 representing the mixing device is rotated in the direction of the arrow 22 by a drive which i not shown in the drawing, so that the balls still held in the drawing receptacles 11 from the previous play fall out of the drawing receptacles 11 and in each case move toward the three other balls in the applicable chamber 1; the four balls 7, 8, 9, 9 are mixed with each other in a free play of forces in each chamber 1 during this mixing process.

After mixing, which preferably is conducted in reversing manner, the drum 2 assumes a position according to FIG. 3, so that the balls which were thoroughly mixed during mixing are each deposited in random sequence in an intermediate receptacle 14, and thus in each chamber 1 lie next to each other in the four intermediate receptacles 14. If the gates 17 were not present, the four balls in each chamber 1 would now move in the direction of the drawing receptacle 11 of the applicable chamber during further rotation of the drum 2 around the longitudinal axis thereof in the direction of the arrow 22. Thus, in the first place, it would not be ensured that a ball would be received reliably by the drawing receptacle 11. In particular, however, it could not be achieved that drawing would be performed from each intermediate receptacle 14 with the same frequency.

Each intermediate receptacle 14 is therefore allocated a T-shaped catch 19, the arrangement being organized such that, after the mixing process and before the actual drawing, three intermediate receptacles 14 are blocked at any time by a retaining finger 21, while the catch 19 of the other intermediate receptacle 14 is located in a position in which no retaining finger 21 can engage with the applicable intermediate receptacle 14 through the slot 16 thereof, so that, during a further rotation of the drum 2, the ball located in this intermediate receptacle 14, because of the free mobility thereof, is preferred over the other balls of the applicable chamber 1 and reliably finds the way to the drawing receptacle 11 of the applicable chamber 1, whereas the blocked balls during this further rotation process ultimately pass over the applicable retaining finger 21 and fall back into the chamber 1, so that, after the drawing process, when the drum has stopped in the position according to FIGS. 1 and 2, a condition obtains in which one of the four balls is held in each drawing receptacle 11 of each chamber 1, while the other three balls have fallen to the bottom of chamber 1.

Mechanical establishment or recording of the playing result is possible by the fact that, allocated to each drawing receptacle 11 is a rocker arm 23 (the rocker arms are only shown in FIG. 1 in the first two chambers 1, but obviously are also provided in other chambers), which on reception of a (blue) ball with the smallest diameter of 20 mm tilts farthest downward from its raised initial position, whereas in the case of a (yellow) ball 8, which has a somewhat larger diameter, it tilts correspondingly less and, in the case of a (black) ball 9, it tilts even less or, depending on configuration, not at all, so that the amount of displacement of the applicable rocker arm 23 is a signal for the type of ball contained in the particular drawing receptacle 11, and the rocker arms 23 operate in combination with an electrical device (for example, a light barrier or the like), which transmits the applicable signal to a recording device, not shown.

In a new play, the gate 17 is displaced either not at all or by one, two or three steps by a drive 24 controlled by a random-number generator, so that, after a displacement, usually effected during the next play, a different intermediate receptacle 14 is not blocked in each chamber 1, while the other three intermediate receptacles are each blocked by a retaining finger 21.

It is obvious that the chance game machine according to the invention is, despite the essentially purely mechanical configuration thereof, a one-hundred-percent, so-called chance machine, and that accordingly the playing results are governed without restriction by the laws of chance. This is already ensured in itself by the very mixing process, concerning which, because of the gate 17, which at any time during the drawing process blocks three of the four balls lying side-by-side in random arrangement and does not block but instead releases only one randomly determined intermediate receptacle 14, so that, in successive plays, drawing occurs externally or internally in random sequence from the balls which are already arranged randomly after mixing, particularly clearly for everyone, since this additional effect is virtually further overlapped with the actual random process, so that drawing of a particular ball variety in somehow preferred manner is prevented with one-hundred-percent reliability.

I claim:

1. A chance game device, said device comprising:

a drawing chamber containing a group of playing elements, said group of playing elements having at least two differently designed playing elements;

a drawing receptacle coupled to said drawing chamber;

at least one drawing means for selecting one of said playing elements and feeding said selected playing element to said drawing receptacle;

at least one mixing means for mixing said playing elements within said drawing chamber during a mixing phase;

a plurality of intermediate receptacles formed in said drawing chamber, each of said receptacles having an inlet and an outlet, the number of said intermediate receptacles corresponding to the number of said playing elements, each of said intermediate receptacles receiving one of said playing elements through said inlet after the mixing phase;

a gate means for randomly blocking all but one of said outlets during a first drawing phase, said playing element that is not blocked being fed via said drawing means to said drawing receptacle during a second drawing phase.

2. The chance game machine according to claim 1, wherein a plurality of chambers (1), which each contain a group of playing elements (7, 8, 9, 9), is provided.

3. The chance game machine according to claim 2, wherein the groups of playing elements (7, 8, 9, 9) in the chambers (1) are identical.

4. The chance game machine according to claim 2, wherein six chambers (1) are present.

5. The chance game machine according to claims 2, 3 or 4, wherein the chambers (1) are arranged side-by-side.

6. The chance game machine according to claim 2, wherein either the mixing means or the drawing means of a plurality of chambers are to be operated simultaneously.

7. The chance game machine according to claim 6, wherein all mixing devices or drawing devices are to be operated simultaneously.

8. The chance game machine according to claim 2, wherein the mixing means (2) and the drawing means of a plurality of chambers (1) are to be operated simultaneously.

9. The chance game machine according to claim 8, wherein all mixing means (2) and drawing means are to be operated simultaneously.

10. The chance game machine according to claim 8, wherein one mixing means (2) is provided for all chambers (1).

11. The chance game machine according to claim 1, wherein the playing elements (7, 8, 9) are balls.

12. The chance game machine according to claim 1, wherein, in a group of playing elements (7, 8, 9) allocated to a chamber (1), at least two playing elements (9, 9) of one playing-element variety (9) are present.

13. The chance game machine according to claim 1, wherein a group of playing elements (7, 8, 9, 9) allocated to a chamber (1) consists of three differently designed playing elements (7, 8, 9).

14. The chance game machine according to claim 1, wherein a group of playing elements (7, 8, 9, 9) allocated to a chamber (1) consists of four playing elements (7, 8, 9, 9), of which two playing elements (9, 9) are identical.

15. The chance game machine according to claim 1, wherein the mixing means consists essentially of a drum which is rotatable around an essentially horizontal axis of rotation (3).

16. The chance game machine according to claim 15, wherein, in a design with several chambers (1), the chambers (1) are each formed by two disk-shaped walls (4, 6), arranged with mutual horizontal spacing, arranged essentially radially with respect to the axis of rotation (3).

17. The chance game machine according to claim 15 or 16, wherein the drum (2) is rotatable, by means of a drive, around the longitudinal (3) axis thereof.

18. The chance game machine according to claim 17, wherein the drum (2) is reversibly drivable.

19. The chance game machine according to claim 1, wherein the intermediate receptacles (14) are designed as tracks, which are adapted to the playing-element configuration, and which are arranged on the inside of the mixing means (2) and are each in communication with the drawing receptacle (11) of the applicable chamber (1).

20. The chance game machine according to claim 19, wherein the intermediate receptacles (14) are inclined toward the allocated drawing receptacle (11).

21. The chance game machine according to claim 1, wherein, allocated to a drawing receptacle (11) is an automatic evaluation device (23), by means of which the variety of a drawn playing element is automatically determinable.

22. The chance game machine according to claim 21, wherein the drawing receptacle (11) has a receiving hole, the diameter of which is smaller than the diameter of the smallest playing element (7).

23. The chance game machine according to claim 1, wherein the intermediate receptacles are each provided with a through-slot (16) extending in the longitudinal direction thereof.

24. The chance game machine according to claim 1, wherein the gate means (17) has catches (19), which are each allocated to an intermediate receptacle (14), concerning which each catch (19) has three retaining fingers (21) arranged at right angles to each other in offset manner and the arrangement is organized such that, during the drawing process, one intermediate receptacle 14 at any time is not blocked by a retaining finger (21), while the other intermediate receptacles (14) of a chamber (1) are blocked during the drawing process.

25. The chance game machine according to claim 24, wherein the catches (19) are arranged on a common axis (18) which, before or during a play, is rotatable by at least one retaining-finger division by a drive (24) controlled by a random-number generator.

26. The chance game machine according to claim 24 or 25, wherein, when a plurality of chambers (1)is present, the position of the retaining fingers (21) in the chambers (1) is different.

27. The chance game machine according to claim 26, wherein the position of the retaining fingers (21) is such that intermediate receptacles (14) located partly outside and intermediate receptacles (14) located partly inside in each position of the gate means (17) are not blocked.

28. The chance game machine according to claim 1, wherein said differently designed playing elements are different sizes.

29. The chance game machine according to claim 1, wherein said differently designed playing elements have different outer surfaces.

30. The chance game machine according to claim 1, wherein said differently designed playing elements are different colors.

* * * * *